US007066625B1

(12) United States Patent
Lin

(10) Patent No.: US 7,066,625 B1
(45) Date of Patent: Jun. 27, 2006

(54) STAIRCASE COMBINATION OF THE GANG SOCKETS

(76) Inventor: Mei-Lu Lin, P.O. Box 697, Fongyuan City, Taichung County 420 (TW)

( * ) Notice: Subject to any disclaimer, the term of this patent is extended or adjusted under 35 U.S.C. 154(b) by 120 days.

(21) Appl. No.: 10/852,565

(22) Filed: May 25, 2004

(51) Int. Cl.
*F21S 13/14* (2006.01)

(52) U.S. Cl. ..... 362/252; 362/227; 362/238; 362/240; 362/249; 362/653; 362/654; 362/807

(58) Field of Classification Search ..... 362/252, 362/238, 240, 249, 654, 807, 652, 653, 227
See application file for complete search history.

(56) References Cited

U.S. PATENT DOCUMENTS

2005/0135119 A1* 6/2005 Lin ..... 362/654

* cited by examiner

*Primary Examiner*—Stephen Husar

*Assistant Examiner*—Meghan K. Dunwiddie

(57) ABSTRACT

A staircase combination of the gang socket includes a plurality of integrally formed tubular sockets each having a bottom partially connected to the upper rim of the next socket and so on until a last socket partially connected its upper rim to the bottom of the socket positioned at above. Each of the sockets has a vertically cutting opening in a lateral side and closed by a plurality of integrally formed covers which are also connected partially their lower end to an upper end of the next covers, a common contact plate disposed between each of the adjacent sockets, a pair of single contact plate disposed within a first and last sockets opposite to the common contact plates and each connected with an electric wire, a plurality of lamps respectively inserted into the sockets.

6 Claims, 9 Drawing Sheets

STAIRCASE COMBINATION OF THE GANG SOCKETS

BACKGROUND OF THE INVENTION

The present invention relates to Christmas lights, and more particularly to staircase combination of the gang sockets for Christmas lights.

The typical prior art Christmas lights includes a socket, a lamp which is composed of a base, a bulb and pair of lead-in wires and a pair of electric wires connected with each of the sockets to supply the electricity to light the lamps in a string of Christmas lights. Lately, the gang type of sockets have been developed and appeared in the market which combines a plurality of sockets together to form a gang shaped Christmas lights in order to attract the people due to its collective lights. However, the combination of the sockets one by one is of the manual job which is easily caused failures on the incorrect assembly of the contact plates. Any one of the contact plates is failed to dispose at its correct position that will cause the disconnection of the electricity in the entire sockets of the gang. So that this type of gang sockets is not so ideal but costs more.

SUMMARY OF THE PRESENT INVENTION

The present invention has a main object to provide a staircase combination of the gang sockets which the gang sockets and covers are integratedly formed. The covers are connected to the sockets at one step by the high frequency wave after the disposing of the contact plates. So as to get rid of the individual connection and the problem of disconnection of the electricity.

Another object of the present invention is to provide a staircase combination of the gang sockets which can make different shapes of the string of Christmas lights and is limitless at a single shape.

Accordingly, the staircase combination of the gang sockets of the present invention comprises more than two sockets integrally produced such that each of the sockets has a vertical opening in one side and in the bottom of the first socket which is partially integrated with the upper rim of the second socket and the bottom of a second socket is partially integrated with the upper rim of a third socket and so on until the gang of the sockets is long enough, a common retaining groove is formed between each of the adjacent sockets for disposing a common contact plate therein and only the first and the last socket each has another single retaining groove for disposing a single contact plate from an electric wire, a plurality of the covers which are also integrated with each other and have the corresponding number relative to that of the sockets so they are respectively engaged with vertical openings of the gang sockets and connected by means of high frequency waves, and a corresponding number of lamps respectively disposed into the upper rim of each of the gang sockets and each has a base, a bulb in the top of the base and a pair of lead-in wires attached to the lateral surfaces of the base engaged with the common contact plates and/or the single plates of the first and the last sockets. So that a staircase combination of the gang sockets is therefore achieved as a string of Christmas lights which is durable and in which both the common contact plates and/or the single contact plates are stably to connect the electricity from the first socket to the last socket.

The present invention will become more fully understood by reference to the following detailed description thereof when read in conjunction with the attached drawings.

DETAILED DESCRIPTION OF THE PREFERRED EMBODIMENT

Figure 1:
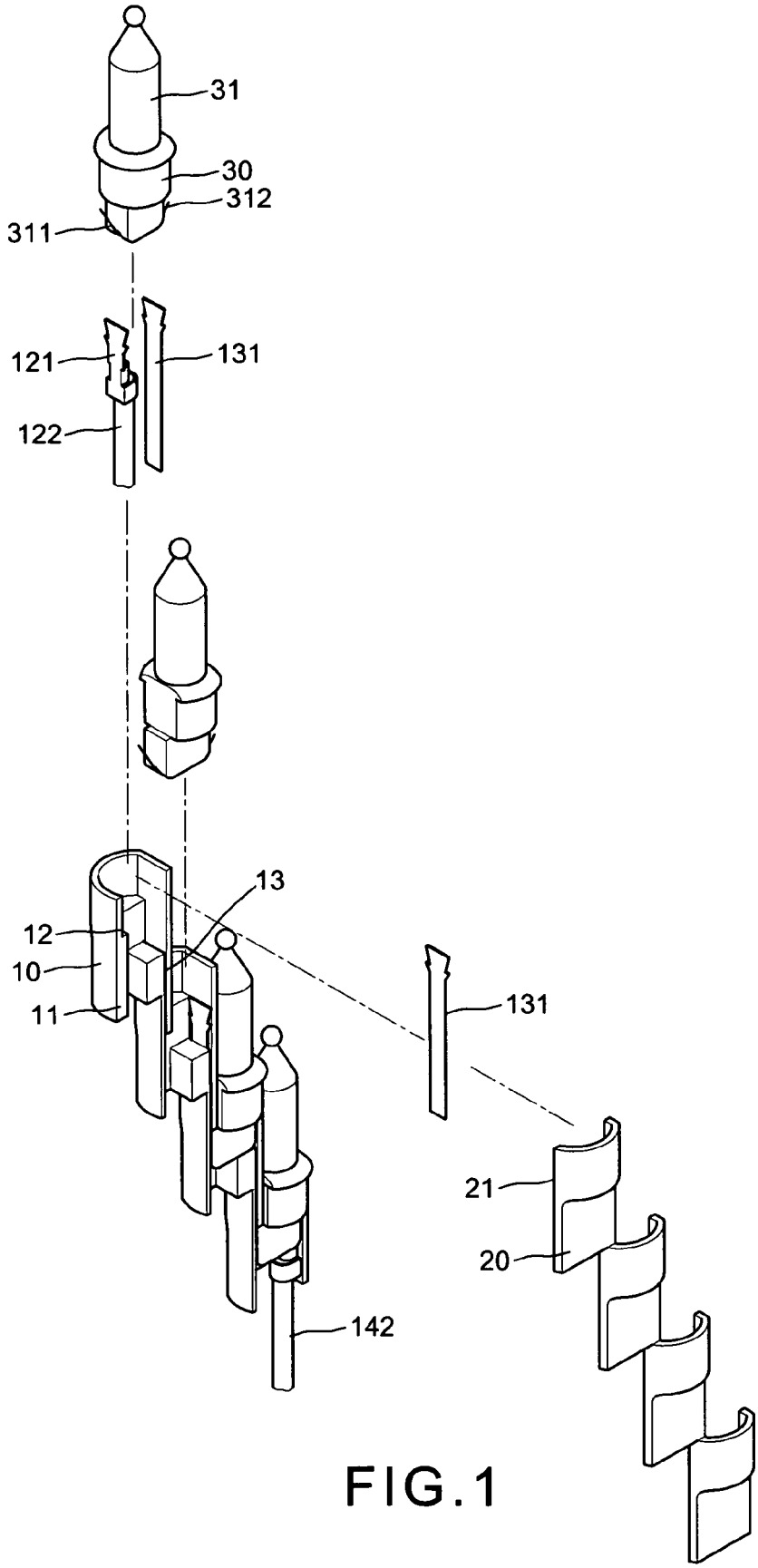
FIG. 1 is an exploded perspective view of the preferred embodiment of the gang sockets of the present invention.
Figure 2:
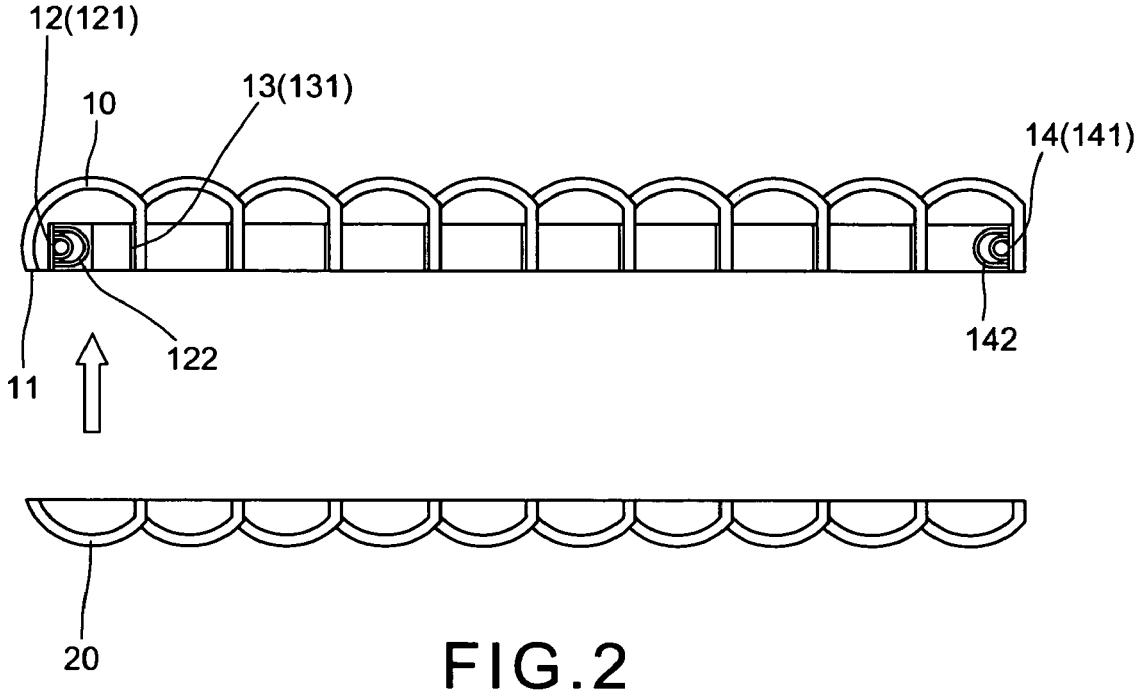
FIG. 2 is a top view indicating that the integrated covers are separated from the gang sockets.
Figure 3:
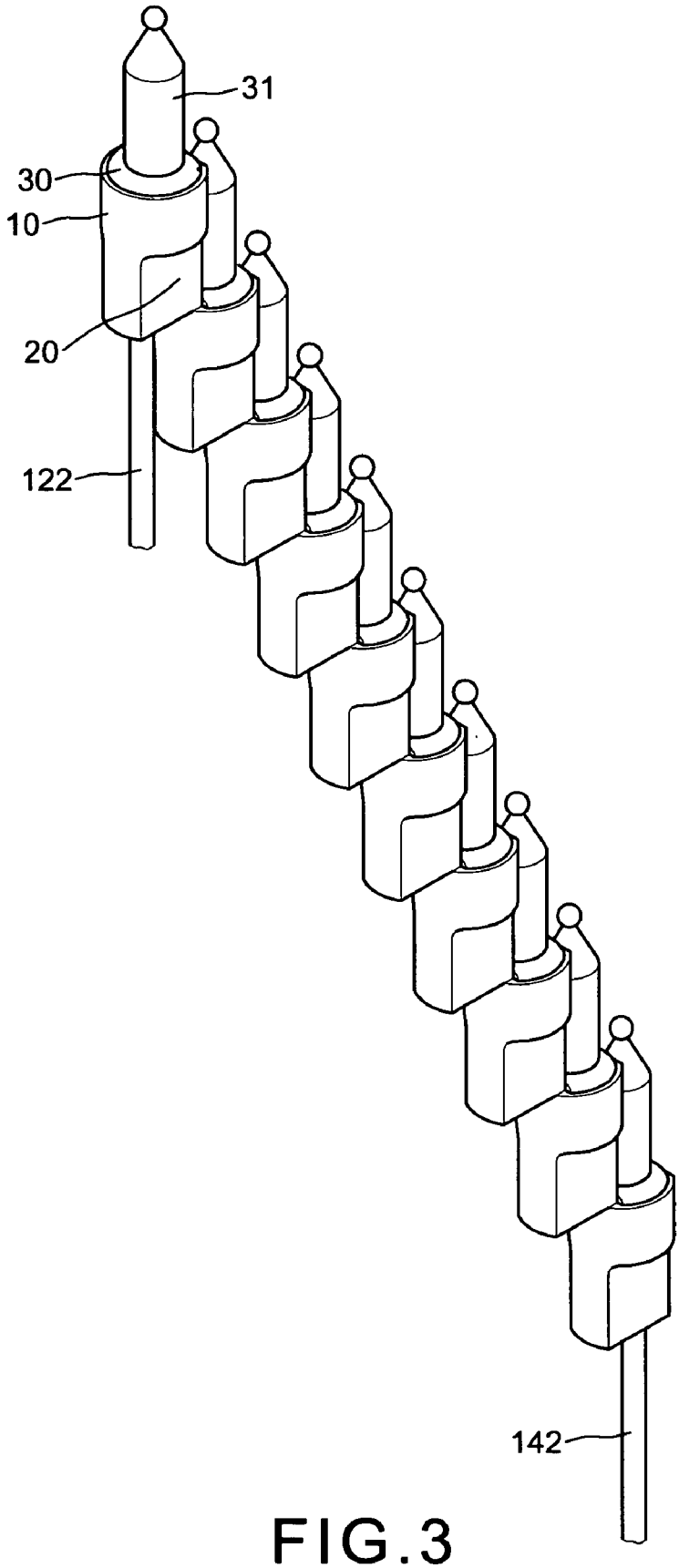
FIG. 3 is a perspective view to show the assembly of the staircase combination of the gang sockets.
Figure 4:
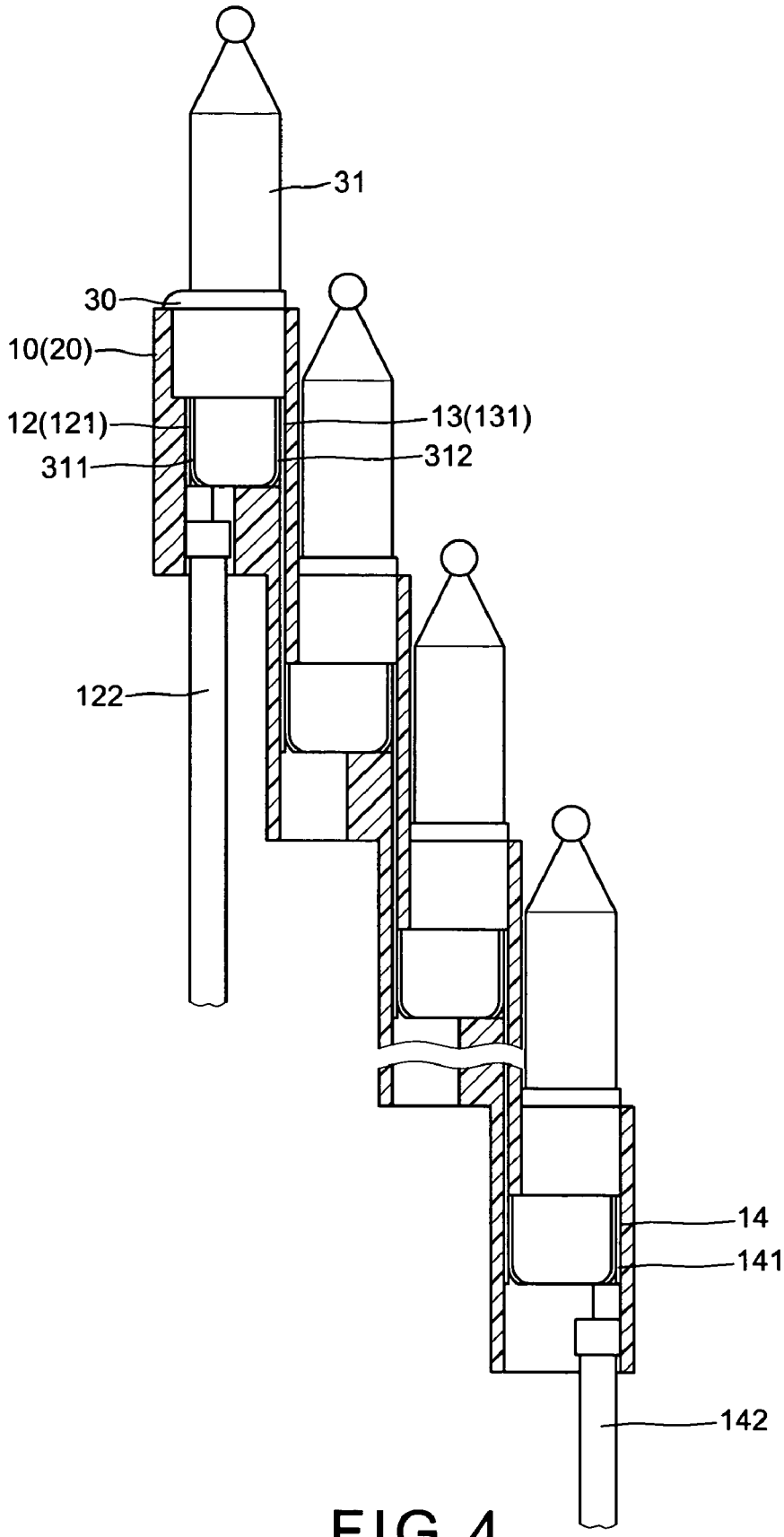
FIG. 4 is a sectional view of FIG. 3.

With reference to FIGS. 1 to 4 of the drawings, the staircase combination of the gang sockets of the present invention comprises a plurality of integrally formed tubular socket 10 by the way that the bottom of a first socket is partially integrated with the upper rim of a second socket and the bottom of the second socket is partially integrated with the upper rim of third socket and so on until a gang sockets is long enough. Each of the combined sockets 10 has a vertically cutting surfaces 11 in one side, a single retaining groove 12 in the first and a last socket 10 for respectively engaging a single contact plate 121 each of which connects to an electric wire 122 and 142. A common retaining groove 13 formed between each of the adjacent sockets 10 for engaging a piece of common contact plate 131 or a single contact plate 121 and 141 of a pair of electric wires 122 and 142 in the first and last sockets 10 therein. A plurality of the covers 20 integrally formed with their lower ends partially connected with their upper ends of the adjacent lower covers 20 each of which has the vertically cutting surfaces 21 made engageable with the vertically cutting surfaces 11 of the sockets 10 so that the covers are respectively covered the opening of the sockets 10 and connected by means of high frequency waves. A plurality of the lamps 30 respectively insert into the upper rim of the sockets 10 and each has a base engaged with a bulb 31 and a pair of lead-in wires 311 and 312 which are attached to the lateral outer surfaces of the base and respectively engaged with the common contact plates 131 or a common contact plate 131 and a single contact plate 121 or 141 in the first and last sockets (as shown in FIG. 4).

The socket 10 and the covers 20 are made integrally as well as the contact plates 121, 131 and 141 are assembled mechanically, so that the durability of the staircase combination of the gang sockets of the present invention is reliable. Any slight bumping or dashing to the ground will not damage or break its parts but keeps its uniform electric circuit of series connection.

Figure 5:
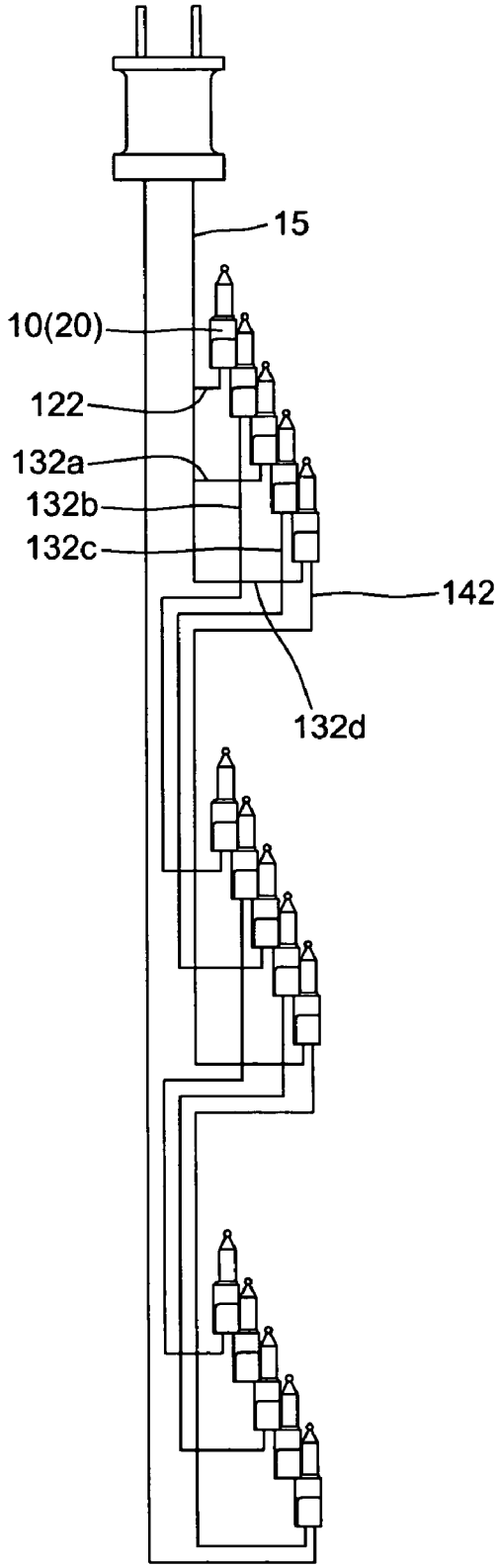
FIG. 5 is a plane view to show that a number of the gang sockets of the present invention are connected with a number of electric wires.

The staircase combination of the gang sockets of the present invention by the addition of the electric wires 132*a*,

132*b*, 132*c*, 132*d* and 15 which converge to a plug in order to achieve a large electric circuit of series connection (as shown in FIG. 5).

Figure 6:
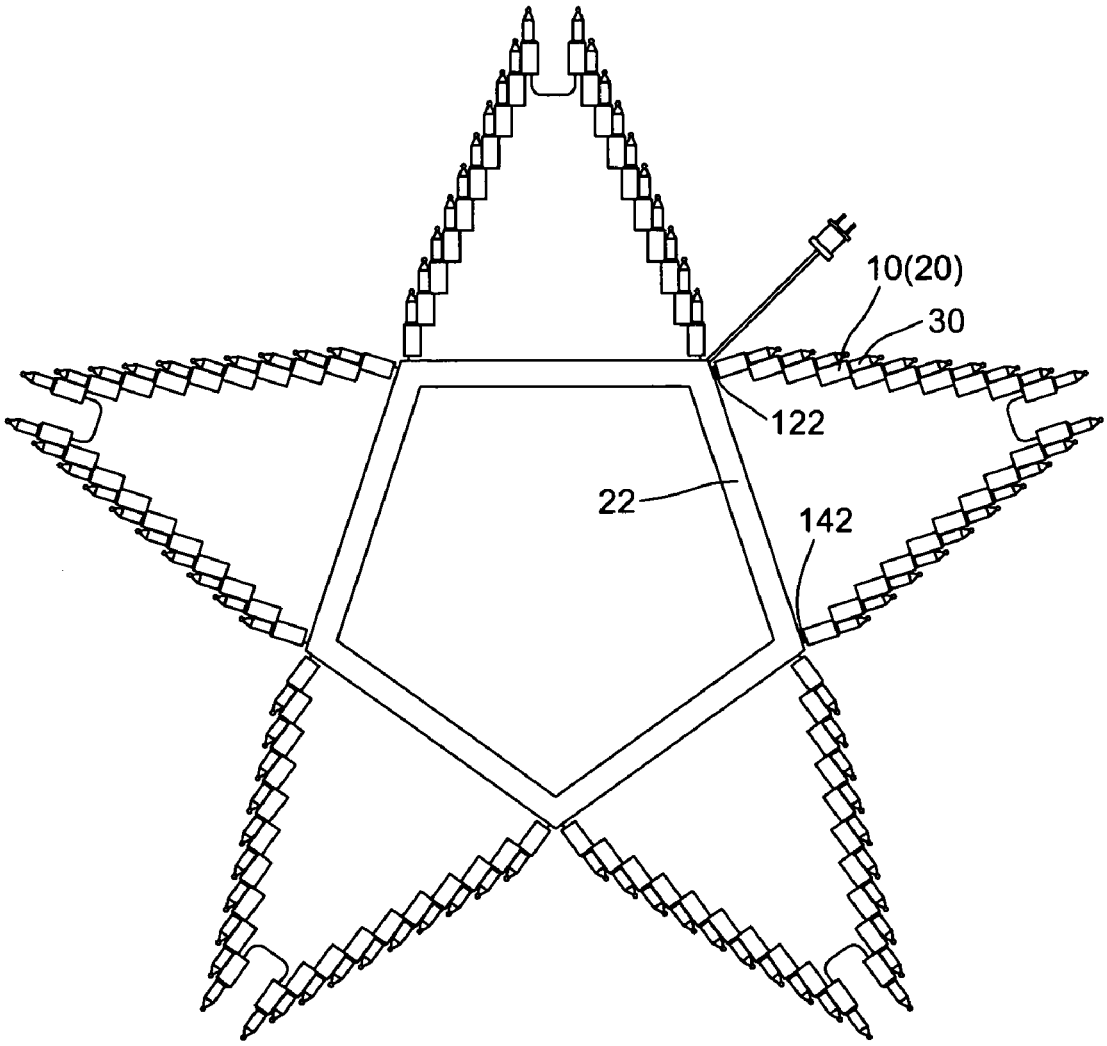
FIG. 6 is a plane view indicating that a number of the gang sockets of the present invention are combined into a star configuration.

FIG. 6 shows a star configuration made of a plurality of the staircase combination of the gang sockets and helped by a pentagon frame 22 which is functioned to connect the electric wires 122 and 142.

Figure 7:
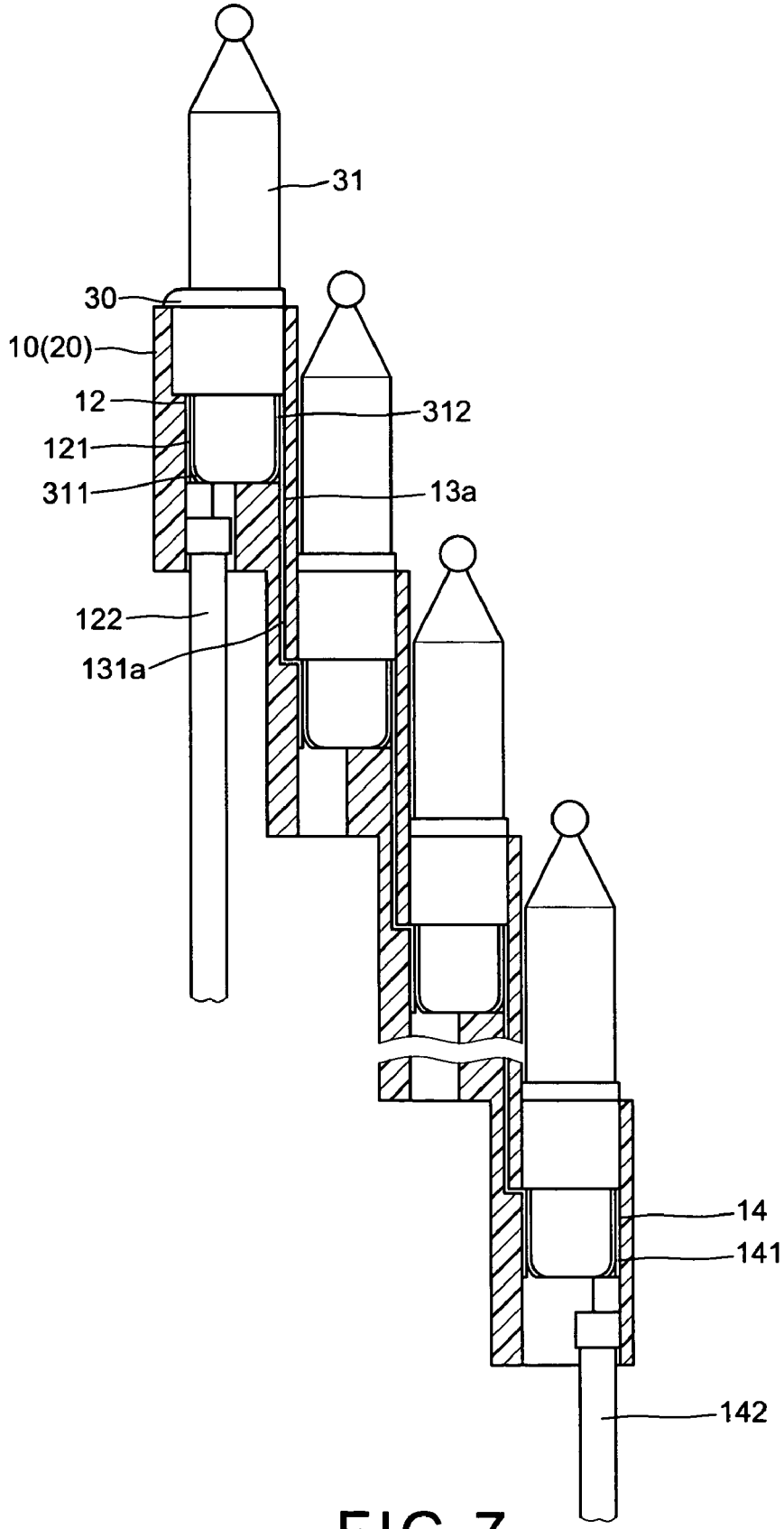
FIG. 7 is a sectional view to show that the common contact plates between the socket are bent into the stepped shapes.

FIG. 7, shows an alternate stepped common retaining groove 13*a* instead of the straight common retaining groove 13 of the above embodiment formed between each of the adjacent sockets 10 for engaging a bent stepped common contact plate 131*a*. Upon this modification, the common contact plate 131*a* will be more stable. However, this bent stepped contact plate 131*a* is very difficult to assemble into a typical prior art socket, But there is no problem to assemble into the socket 10 of the present invention. Because the socket 10 has an opening in one lateral side.

Figure 8:
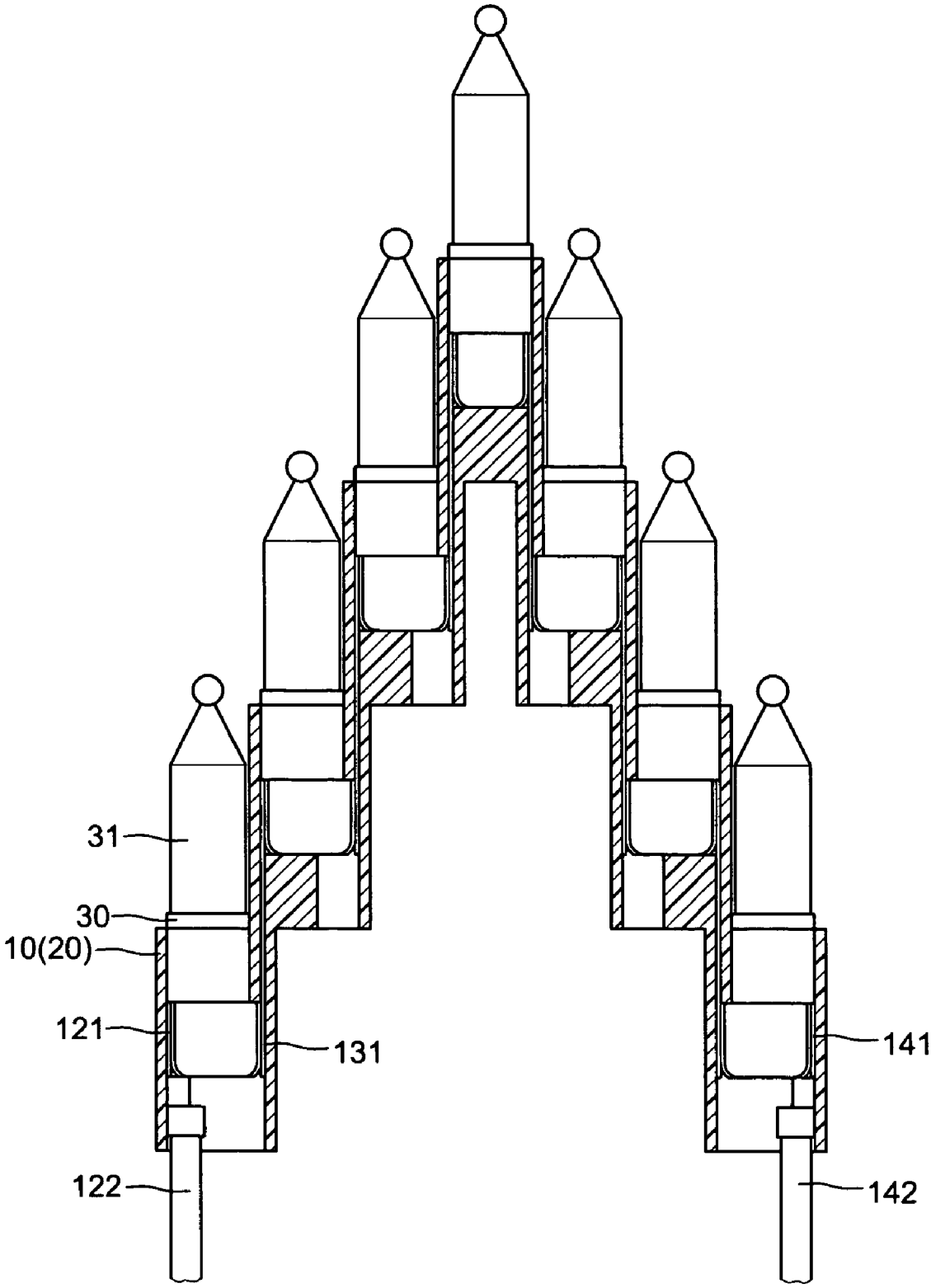
FIG. 8 is a sectional view to show that the gang socket of the present invention is capable of forming an inverse V-shaped configuration and, FIG. 9 is a plane view to show a number of the inverse V-shaped gang sockets are connected in series by additional electric wires.
Figure 9:
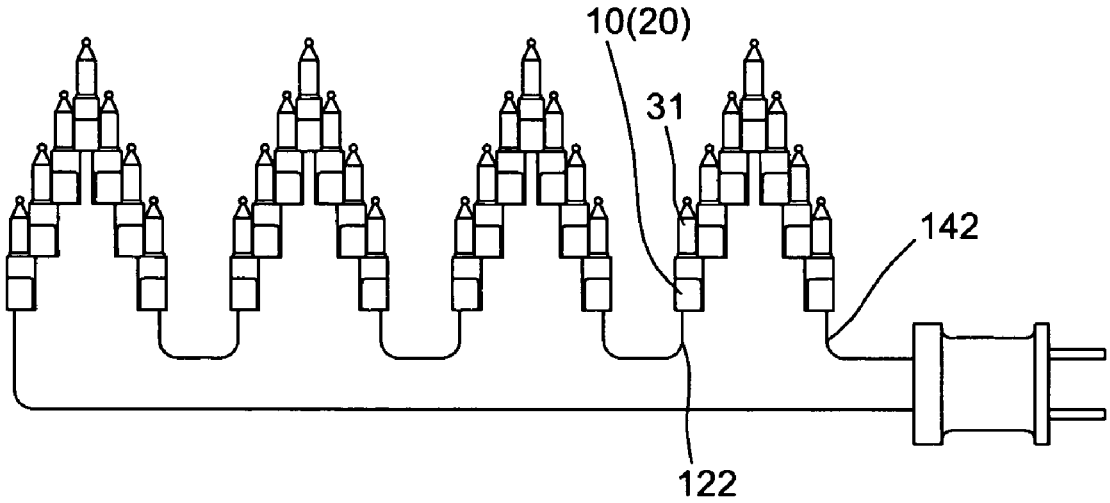

FIG. 8 shows that the above embodiment of the staircase combination of the gang sockets can be arranged into an inverse V-shaped configuration. This arrangement does not change the original structure or any component except that the bottom of the first socket 10 respectively connects partially to the upper rims of two second sockets 10. Several inverse V-shaped configuration of the staircase combination of the gang sockets can be also connected in series by using the electric wires 122 and 142 which are finally converged into a plug (as shown in FIG. 9).

The staircase combination of the gang sockets of the present invention has the following advantages:

a) both the sockets 10 and the covers 20 are integrally formed and connected by means of high frequency waves that ensures its correctness, stability and durability and will not be damaged and/or disassembled under a slight bumping or dashing to the ground, b) provides a convenient assembly and the components are assembled mechanically so as to save the manpower, c) the bent stepped or the V-shaped common contact plate 131*a* and 65 are readily assembled. But it is impossible for a typical prior art socket, and d) the staircase combination of the gang sockets of the present invention can be able to make different shaped configurations of the string of Christmas lights. But it is impossible for the typical prior art socket due to the problems of the structure and the assembly of the contact plates so that they can only be able to make the juxtaposed sockets and/or a trapezoid shaped configuration for the strings of the Christmas lights.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A staircase combination of the gang sockets comprising:

more than two identical tubular sockets integrally formed and each having an upper rim, a lower rim, a lateral opening and a pair of retaining grooves in opposing inner peripheries for disposing a common contact plate therebetween with a first and a last socket each having a single contact plate disposed into an opposing retaining groove facing said common contact plate and connected to an electric wire which extends out of said first and last socket via the lower rim thereof, said socket being connected by the way that the lower rim of the first socket partially connected with the upper rim of a second socket which in turn has a lower rim partially connected with the upper rim of a third socket and so on until the upper rim of the last socket partially connected to the lower rim of an adjacent socket thereabove;

more than two covers closing the openings of said sockets and each having an upper end and a lower end, said covers being integrally formed and connected each other by the way that the lower end of a first cover partially connected to the upper end of a second cover which has the lower end partially connected to the upper end of a third cover and so on until a last cover being appeared, said covers being finally connected to said sockets respectively by means of high frequency waves;

more than two lamps respectively inserted into the upper rims of said sockets and each having a base, a bulb in top of the base and a pair of lead-in wires attached to opposing outer peripheries of the base and engaged with said common contact plates wherein a first and a last lamp having their lead-in wires respectively engaged with the common contact plate and a single contact plate positioned opposite to said common contact plate.

whereby a series electric circuit is established within said sockets.

2. The staircase combination as recited in claim 1, wherein said gang sockets can plural to make a string of Christmas lights by adding a plurality of electric wires in and converged to a plug.

3. The staircase combination as recited in claim 1, wherein said sockets can be plural to make star shaped configuration by adding a pentagon frame in center.

4. The staircase combination as recited in claim 1, further has a bent stepped retaining groove formed between each of adjacent sockets for engaging with a bent stepped common contact plates therein.

5. The staircase combination as recited in claim 1, wherein said staircase combination of the gang sockets is capable of making an inverse V-shaped configuration by connecting partially the lower rim of the first socket to the upper rims of a pair second sockets which in turn respectively connect their partial lower rims to a pair of third sockets and soon to develop the gang sockets toward two directions until a pair of last sockets partially connecting their upper rims to a pair of sockets above them and each engaged with a single contact plate from an electric wire in an inner periphery opposite to the common contact plate.

6. The staircase combination as recited in claim 4, wherein said inverse V-shaped configuration of gang sockets can be plural and connected in series by lengthening their electric wires which are finally converged to a plug.

* * * * *